US008556667B2

(12) United States Patent
Koyama et al.

(10) Patent No.: US 8,556,667 B2
(45) **Date of Patent: *Oct. 15, 2013**

(54) TERMINAL AND CONNECTOR WITH TERMINAL

(75) Inventors: Jiro Koyama, Otsu (JP); Hirotada Teranishi, Kusatsu (JP)

(73) Assignee: OMRON Corporation, Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/260,943

(22) PCT Filed: Mar. 24, 2011

(86) PCT No.: PCT/JP2011/057172

§ 371 (c)(1),
(2), (4) Date: Nov. 9, 2011

(87) PCT Pub. No.: WO2012/060119

PCT Pub. Date: May 10, 2012

(65) Prior Publication Data

US 2012/0171905 A1 Jul. 5, 2012

(30) Foreign Application Priority Data

Nov. 4, 2010 (JP) ..... 2010-247556

(51) Int. Cl.
*H01R 4/48* (2006.01)

(52) U.S. Cl.
USPC ..... 439/862; 439/500; 439/474

(58) Field of Classification Search
USPC ..... 439/474, 500, 862
See application file for complete search history.

(56) References Cited

U.S. PATENT DOCUMENTS

| | | | | |
|---|---|---|---|---|
| 5,286,208 | A * | 2/1994 | Matsuoka | 439/72 |
| 5,556,306 | A * | 9/1996 | Lin et al. | 439/637 |
| 7,364,434 | B2 * | 4/2008 | Hu et al. | 439/66 |
| 8,197,290 | B2 * | 6/2012 | Koyama et al. | 439/862 |
| 8,231,417 | B2 * | 7/2012 | Zhu | 439/862 |
| 8,267,725 | B2 * | 9/2012 | Zhu | 439/660 |

(Continued)

FOREIGN PATENT DOCUMENTS

| | | |
|---|---|---|
| JP | 2001-237015 A | 8/2001 |
| JP | 3120893 U | 4/2006 |

OTHER PUBLICATIONS

International Search Report from PCT/JP2011/057172 dated May 10, 2011 (2 pages).

(Continued)

*Primary Examiner* — James Harvey
(74) *Attorney, Agent, or Firm* — Osha Liang LLP

(57) ABSTRACT

A space-saving terminal includes a depth that is short and a floor space that is small. The terminal further includes a fixing part for press-in pressed into and fixed to a base material, a support part projected upward so as to cross with the fixing part for press-in, two extension parts extended downward while meandering from a branch portion on a tip of the support part so as to form a meandering slit, and a movable contact part projected from a tip portion formed by integrating free ends of the extension parts so as to be capable of moving in and out of a contacting hole of the base material. The support part is curved outward in order to avoid contact with the tip portion of the extension part while the tip portion is displaced.

19 Claims, 3 Drawing Sheets

(56) References Cited

U.S. PATENT DOCUMENTS

| | | | | |
|---|---|---|---|---|
| 2006/0246746 | A1 | 11/2006 | Hu et al. | |
| 2011/0177726 | A1* | 7/2011 | Koyama et al. | 439/839 |
| 2011/0189905 | A1* | 8/2011 | Koyama et al. | 439/877 |
| 2012/0108111 | A1* | 5/2012 | Koyama et al. | 439/746 |
| 2012/0171905 | A1* | 7/2012 | Koyama et al. | 439/676 |

OTHER PUBLICATIONS

Written Opinion from PCT/JP2011/057172 dated May 10, 2011 (3 pages).

* cited by examiner

TERMINAL AND CONNECTOR WITH TERMINAL

BACKGROUND OF INVENTION

1. Technical Field

One or more embodiments of the present invention relate to a terminal, for example, a terminal is not only incorporated in a housing to configure a connector, but also directly mounted on a board for use.

2. Background Art

As a conventional terminal, for example, a contact for an IC socket in which a terminal contact part is integrally formed via a spring side part of which a base portion is connected to a support side part, is known (see Patent Document 1). The spring side part of this contact is approximately formed in a lateral U-shape by an upper side arm extended from a coupling portion to the terminal contact part and a lower side arm extended from the coupling portion to the base portion. The upper side arm includes a first spring portion and a second spring portion which are extended away from and in parallel with each other. The lower side arm includes a third spring portion and a fourth spring portion which are extended away from and in parallel with each other. Further, the spring side part slopes down from the coupling portion to the base portion.

Patent Document

Patent Document 1: Japanese Unexamined Patent Publication No. 2001-237015

Regarding the contact for an IC socket mentioned above, for example, as shown in FIG. 4 of Patent Document 1, a linear upper side arm 2 and a linear lower side arm 3 are coupled at a coupling portion 8. Therefore, a depth of the contact is long and a floor space of the contact is large, and hence a large mounting space is required.

SUMMARY OF INVENTION

One or more embodiments of present invention provide a space-saving terminal in which a depth is short and a floor space is small.

A terminal according to one or more embodiments of the present invention includes: a fixing part for press-in, pressed into and fixed to a base material; a support part projected upward so as to cross with the fixing part for press-in; a plurality of extension parts extended downward while meandering from a branch portion provided on a tip of the support part so as to form at least one meandering slit; and a movable contact part projected from a tip portion formed by integrating free ends of the extension parts so as to be capable of moving in and out of a contacting hole of the base material, wherein the support part is curved outward in order to avoid contact with the tip portion of the extension parts while the tip portion is displaced.

According to one or more embodiments of the present invention, the support part is curved outward so that the tip portion of the extension parts does not come into contact even if the tip portion of the extension parts extended downward is laterally disposed. Accordingly, a lateral distance between the tip portion of the extension parts and a base portion of the support part can be reduced, so that a space-saving terminal in which a depth is short and a floor space is small, is provided.

In one or more embodiments of the present invention, a width of the slit may be determined so as to be capable of avoiding contact of the neighboring extension parts with each other in motion.

According to one or more embodiments of the present invention, because the extension parts do not come into contact with each other, a smoothly movable terminal is provided in which dissonant contact noises are not generated.

In one or more embodiments of the present invention, widths of the plurality of extension parts may differ from each other.

According to one or more embodiments of the present invention, the width of the slit can be appropriately selected as required, and thereby stress concentration does not occur and durability is improved. In addition, the extension parts are prevented from coming into contact with each other, and hence a smoothly movable terminal is provided in which dissonant contact noises are not generated.

In one or more embodiment of the present invention, a width of a greatly curved portion of one of the extension parts may be gradually increased.

According to one or more embodiments of the present invention, a terminal is provided in which extreme stress concentration does not occur, durability is improved, and the life is longer.

In one or more embodiments of the present invention, a contact part for positioning which comes into contact with a receiving part for positioning of the base material may be provided on the periphery of the movable contact part.

According to one or more embodiments of the present invention, because the extension parts of the terminal can be accurately located on a predetermined position, motion characteristics are improved.

A connector according to one or more embodiments of the present invention is configured such that the fixing part for press-in of the terminal mentioned above is pressed into and fixed to a press-in hole of a housing as the base material, and the movable contact part is projected from a contacting hole formed in the housing so as to be capable of moving in and out of the contacting hole.

The connector according to one or more embodiments of the present invention has high contact reliability and a long life.

In one or more embodiments of the present invention, the contact part for positioning formed on the periphery of the movable contact part of the terminal may be brought into contact with the receiving part for positioning formed on an edge portion of the contacting hole of the housing so as to be positioned.

According to one or more embodiments of the present invention, because the movable contact part of the terminal can be highly accurately positioned, a connector having invariable motion characteristics is provided.

DETAILED DESCRIPTION

Embodiments of a terminal according to the present invention will be described with reference to accompanying FIGS.

1A to 3B. In embodiments of the invention, numerous specific details are set forth in order to provide a more thorough understanding of the invention. However, it will be apparent to one with ordinary skill in the art that the invention may be practiced without these specific details. In other instances, well-known features have not been described in detail to avoid obscuring the invention.

As shown in FIGS. 1A to 3B, one or more embodiments are associated with a connector in which fixing brackets 20 are pressed into both of side edge portions of a lower surface of a resin-molded housing 10 which is vertically long in cross-section, and in which contact terminals 30 are pressed between the fixing brackets 20, 20 at predetermined intervals.

Figure 1A:
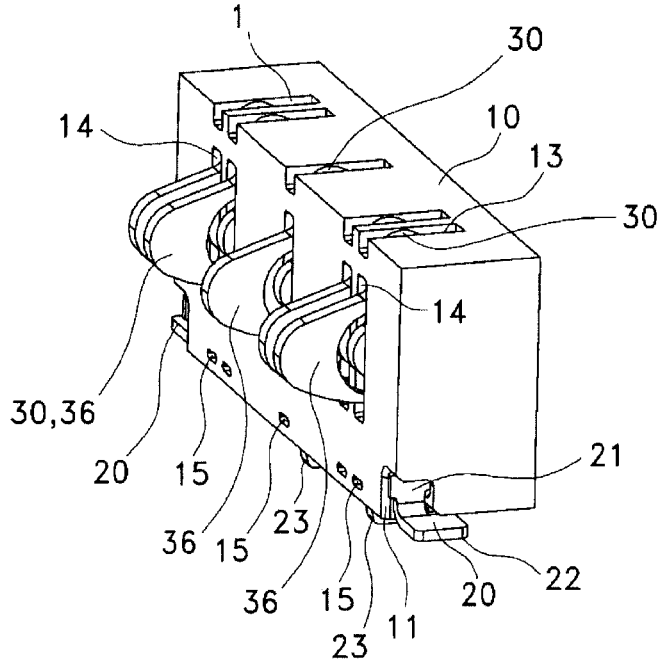
FIGS. 1A and 1B are a perspective view and a top view each illustrating a connector with terminals according to one or more embodiments of the present invention.
Figure 1B:
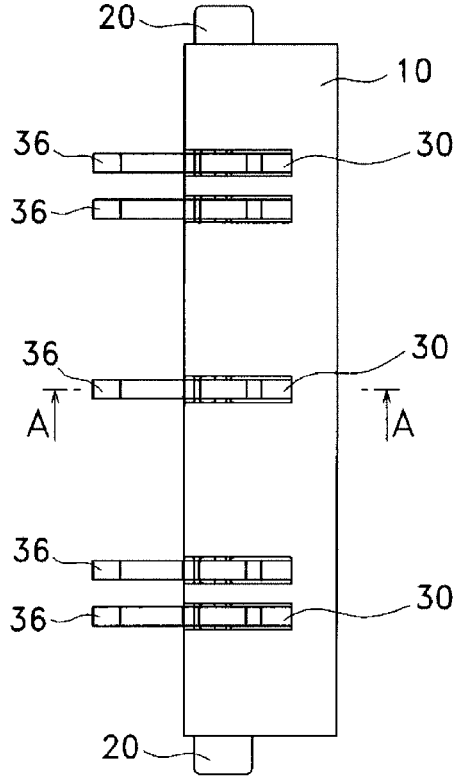

As shown in FIGS. 1A and 1B, first insertion spaces 11 are disposed on both of side edge portions of a bottom of the housing 10, and each of the fixing brackets 20 is pressed into the corresponding first insertion space 11 from the bottom side. Second insertion spaces 13 are arranged between the first insertion spaces 11 (FIGS. 2A and 2B), and each of the contact terminals 30 can be pressed into the corresponding second insertion space 13 from a rear side. Contacting holes 14 are formed on a front side of the housing 10. Each of the contacting holes 14 is communicating with the corresponding second insertion space 13, and movable contact parts 36 to be described below can move in and out of the contacting holes 14, respectively. The housing 10 further has press-in holes 15 each communicating with the corresponding second insertion space 13. Receiving parts for positioning 17 are formed on upper edge portions of the contacting holes 14.

Figure 3A:
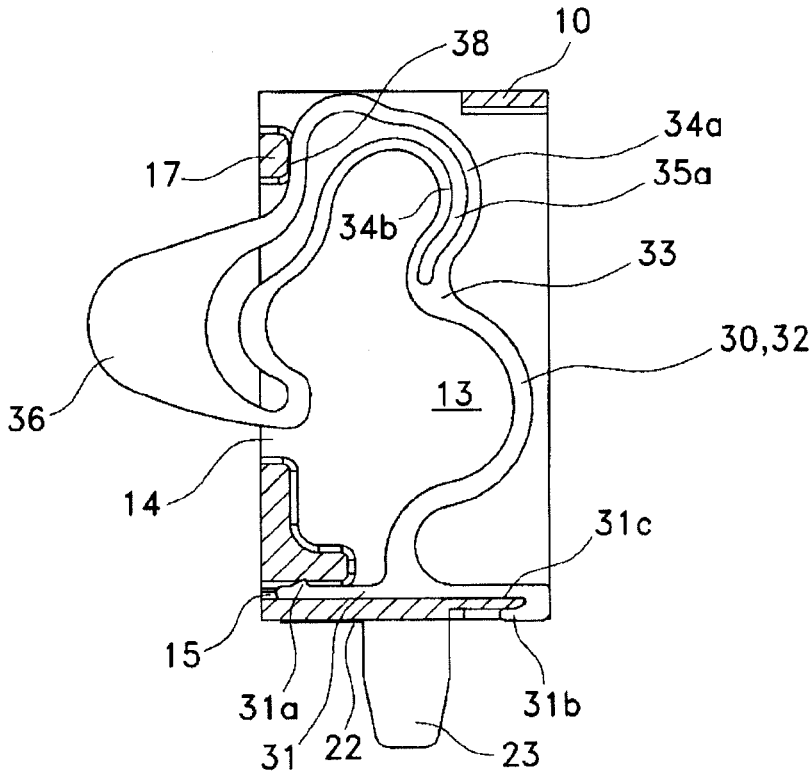
FIGS. 3A and 3B are cross-section views illustrating sequential motions of the terminal according to the one or more embodiments illustrated in FIGS. 1A and 1B.
Figure 3B:
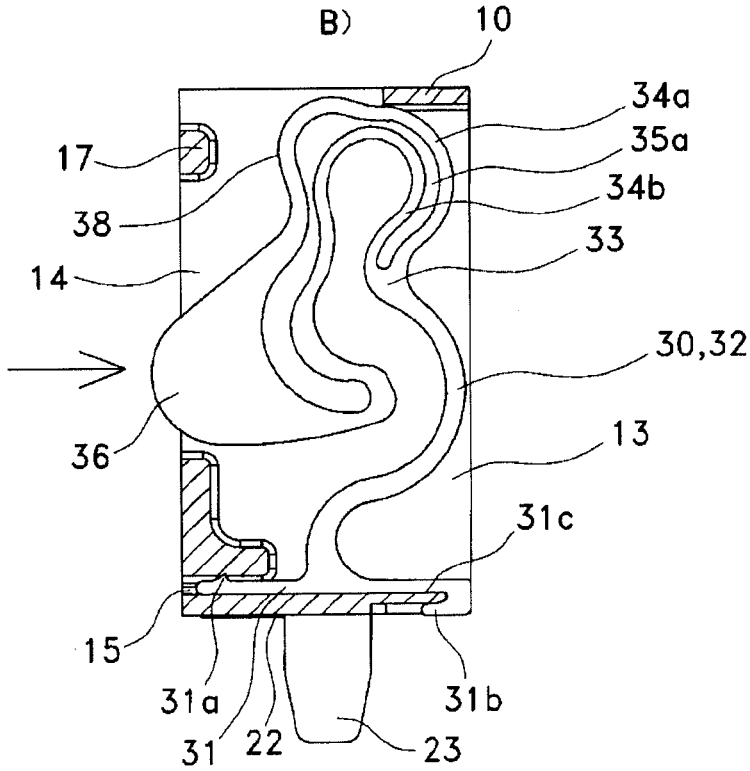

As shown in FIGS. 1A and 1B, the fixing brackets 20 are approximately L-shaped and are press-forming pieces formed by punching out from a thin plate by press working. A vertical portion 21 of each of the fixing brackets 20 is pressed into the corresponding first insertion space 11 from the bottom side, and hence the fixing brackets 20 are retained in the first insertion spaces 11. Lower end portions for fixing 22 of the fixing brackets 20 are exposed from the bottom of the housing 10 for connecting and fixing (FIGS. 3A and 3B). Positioning brackets 23 which can be inserted into through-holes of a printed circuit board (not shown) are pressed into the bottom of the housing 10.

Figure 2A:
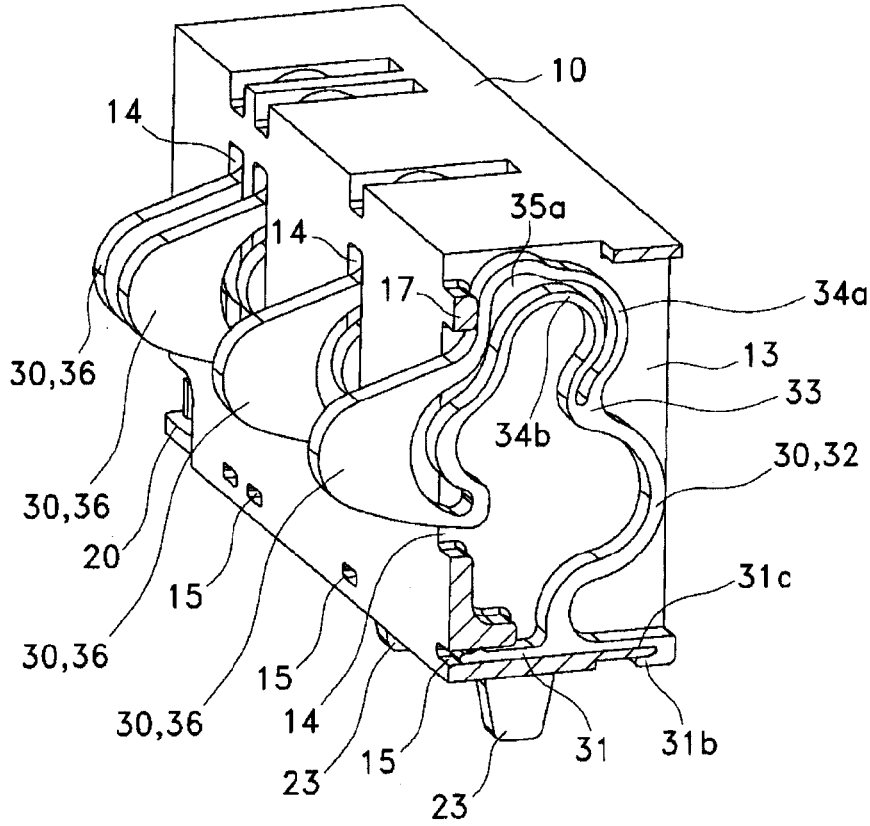
FIGS. 2A and 2B are a cross-sectional perspective view illustrating the connector with the terminals according to the one or more embodiments illustrated in FIGS. 1A and 1B, and a perspective view illustrating the single terminal thereof.
Figure 2B:
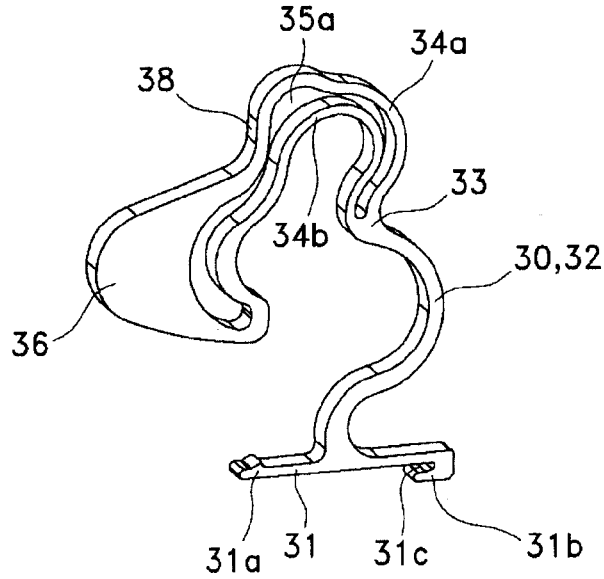

As shown in FIGS. 2A and 2B, each of the contact terminals 30 has a support part 32 projected upward so as to cross with a fixing part for press-in 31, and curved outward. A branch portion 33 is provided on a tip of the support part 32. A latch portion 31*a* is projected from an upper surface of one end portion of the fixing part for press-in 31. An engaging portion 31*b* is formed on a lower surface of the other end portion of the fixing part for press-in 31 so as to configure a notch portion for press-in 31*c*. First and second meandering extension parts 34*a*, 34*b* are extended from the branch portion 33, and thereby a first slit 35*a* is formed. The movable contact part 36 is provided on a free end portion formed by integrating tip portions of the first and second extension parts 34*a*, 34*b*. Each of the contact terminals 30 according to one or more embodiments have a contact part for positioning 38 which is provided in the vicinity of the movable contact part 36 in the first extension part 34*a*. The contact part for positioning 38 comes into contact with a receiving part for positioning 17 of the housing 10, and thereby the contact terminal 30 is positioned.

A width of the first slit 35*a* according to one or more embodiments is determined to have a size such that the first and second extension parts 34*a*, 34*b* do not come into contact with each other even when the movable contact part 36 of the contact terminal 30 is moved. Therefore, the first and second extension parts 34*a*, 34*b* do not come into contact with each other in predetermined motion, thereby exerting the advantage that dissonant contact noises are not generated.

As shown in FIGS. 2A and 2B, each of the contact terminals 30 is inserted into the second insertion space 13 of the housing 10 from the rear side. The fixing part for press-in 31 is pressed into the press-in hole 15, the latch portion 31*a* is caught by an inner surface of the press-in hole 15, and the notch portion 31*c* is engaged with an edge portion of the housing 10. Therefore, the contact terminal 30 can be retained in the second insertion space 13. The contact part for positioning 38 of the contact terminal 30 comes into contact with the receiving part for positioning 17 of the housing 10 so as to be positioned.

When the movable contact part 36 of the connector mounted on a printed circuit board (not shown) is pressed in, the first and second extension parts 34*a*, 34*b* are elastically deformed and the support part 32 is elastically deformed. At this time, because the width of the first slit 35*a* is appropriately large, the first and second extension parts 34*a*, 34*b* do not come into contact with each other within a predetermined amount of pressing. Accordingly, the contact terminals 30 can be smoothly moved without frictional noises.

Because the support part 32 and the first and second extension parts 34*a*, 34*b* are disposed between the movable contact part 36 and the fixing part for press-in 31, the spring length is long and stress concentration hardly occur. Therefore, the connector having high contact reliability and a long life is advantageously provided.

In one or more embodiments, when the movable contact part 36 is pressed inward, because the support part 32 is curved outward, the tip portion of the second extension part 34*b* does not come into contact with the support part 32. Accordingly, the one or more embodiments have the advantage that the space-saving connector in which the depth is short and the floor space is small is provided.

One or more embodiments of the present invention describe the case where the first slit 35*a* is formed by extending the two first and second extension parts 34*a*, 34*b*. However, two slits may be formed by extending three meandering extension parts. In this case, one end portions of the extension parts may be arranged on a same straight line. Alternatively, the first branch part and a first extension part may be extended from the tip portion of the support part, and the second and third extension parts may be extended from the first branch portion.

A projection for positioning may be projected on the periphery of the movable contact part, and the projection for positioning may come into contact with the receiving part for positioning formed on an edge portion of the contacting hole so as to be positioned.

In one or more embodiments as described above, the pair of two contact terminals and the one contact terminal are combined in the housing. However, the combination of each one contact terminal or the combination of each pair of two contact terminals may be adopted. Further, a combination of each triple contact terminals may be adopted, that is, the number of the terminals may be selected obviously as necessary.

It is not indispensable that the first extension part and the second extension part have a uniform width. For example, a greatly curved portion of the extension part disposed on the outer side may be gradually increased in width in order to prevent extreme stress concentration and to improve durability.

In one or more embodiments as described above, the contact terminals are incorporated into the housing as a base material. However, the contact terminals of one or more embodiments of the present invention may be directly incorporated into a side end surface of a printed circuit board as a base material. In this configuration, the housing and the fixing brackets are not required, and hence this configuration has the advantage that the entire device can be downsized.

The terminal according to one or more embodiments of the present invention is not specifically limited to one of the modes described above, as long as having the plurality of meandering extension parts.

DESCRIPTION OF SYMBOLS

10: Base
13: Second insertion space
14: Contacting hole
17: Receiving part for positioning
20: Fixing bracket
23: Positioning bracket
30: Contact terminal
31: Fixing part for press-in
32: Support part
33: Branch portion
34*a*, 34*b*: First and Second extension parts
35*a*: First slit
36: Movable contact part
38: Contact part for positioning While the invention has been described with respect to a limited number of embodiments, those skilled in the art, having the benefit of this disclosure, will appreciate that other embodiments can be devised which do not depart from the scope of the invention as disclosed herein. Accordingly, the scope of the invention should be limited only by the attached claims.

The invention claimed is:

1. A terminal, comprising:

a fixing part for press-in, pressed into and fixed to a base material;

a support part projected upward so as to cross with the fixing part for press-in;

a plurality of extension parts extended downward while meandering from a branch portion provided on a tip of the support part so as to form at least one meandering slit; and a movable contact part projected from a tip portion formed by integrating free ends of the extension parts so as to be capable of moving in and out of a contacting hole of the base material, wherein the support part is curved outward in order to avoid contact with the tip portion of the extension parts while the tip portion is displaced.

2. The terminal according to claim 1, wherein a width of the slit is determined so as to be capable of avoiding contact of the neighboring extension parts with each other in motion.

3. The terminal according to claim 1, wherein widths of the plurality of extension parts differ from each other.

4. The terminal according to claim 1, wherein a width of a greatly curved portion of one of the extension parts is gradually increased.

5. The terminal according to claim 1, further comprising a contact part for positioning, provided on a periphery of the movable contact part, wherein the contact part for positioning comes into contact with a receiving part for positioning of the base material.

6. A connector comprising the terminal according to claim 1, wherein the fixing part for press-in of the terminal is pressed into and fixed to a press-in hole of a housing as the base material, and the movable contact part of the terminal is projected from a contacting hole formed in the housing so as to be capable of moving in and out of the contacting hole.

7. The connector according to claim 6, wherein the contact part for positioning formed on the periphery of the movable contact part of the terminal is brought into contact with a receiving part for positioning formed on an edge portion of the contacting hole of the housing so as to be positioned.

8. The terminal according to claim 2, wherein widths of the plurality of extension parts differ from each other.

9. The terminal according to claim 2, wherein a width of a greatly curved portion of one of the extension parts is gradually increased.

10. The terminal according to claim 3, wherein a width of a greatly curved portion of one of the extension parts is gradually increased.

11. The terminal according to claim 2, further comprising a contact part for positioning, provided on a periphery of the movable contact part, wherein the contact part for positioning comes into contact with a receiving part for positioning of the base material.

12. The terminal according to claim 3, further comprising a contact part for positioning, provided on a periphery of the movable contact part, wherein the contact part for positioning comes into contact with a receiving part for positioning of the base material.

13. The terminal according to claim 4, further comprising a contact part for positioning, provided on a periphery of the movable contact part, wherein the contact part for positioning comes into contact with a receiving part for positioning of the base material.

14. A connector comprising the terminal according to claim 2, wherein the fixing part for press-in of the terminal is pressed into and fixed to a press-in hole of a housing as the base material, and the movable contact part of the terminal is projected from a contacting hole formed in the housing so as to be capable of moving in and out of the contacting hole.

15. A connector comprising the terminal according to claim 3, wherein the fixing part for press-in of the terminal is pressed into and fixed to a press-in hole of a housing as the base material, and the movable contact part of the terminal is projected from a contacting hole formed in the housing so as to be capable of moving in and out of the contacting hole.

16. A connector comprising the terminal according to claim 4, wherein the fixing part for press-in of the terminal is pressed into and fixed to a press-in hole of a housing as the base material, and the movable contact part of the terminal is projected from a contacting hole formed in the housing so as to be capable of moving in and out of the contacting hole.

17. A connector comprising the terminal according to claim 5, wherein the fixing part for press-in of the terminal is pressed into and fixed to a press-in hole of a housing as the base material, and the movable contact part of the terminal is projected from a contacting hole formed in the housing so as to be capable of moving in and out of the contacting hole.

18. The connector according to claim 14, wherein the contact part for positioning formed on the periphery of the movable contact part of the terminal is brought into contact with a receiving part for positioning formed on an edge portion of the contacting hole of the housing so as to be positioned.

19. A connector comprising the terminal according to claim 3, the terminal further comprising:

a contact part for positioning, provided on a periphery of the movable contact part, wherein the contact part for positioning comes into contact with a receiving part for positioning of the base material, wherein a width of a greatly curved portion of one of the extension parts is gradually increased, wherein the fixing part for press-in of the terminal is pressed into and fixed to a press-in hole of a housing as the base material, and the movable contact part of the terminal is projected from a contacting hole formed in the housing so as to be capable of moving in and out of the contacting hole, and wherein the contact part for positioning formed on the periphery of the movable contact part of the terminal is brought into contact with a receiving part for positioning formed on an edge portion of the contacting hole of the housing so as to be positioned.

* * * * *